United States Patent [19]

Kidd

[11] Patent Number: 4,941,767

[45] Date of Patent: Jul. 17, 1990

[54] JOINTS AND STRUCTURES INCORPORATING SAME

[75] Inventor: John E. Kidd, Shorwell, England

[73] Assignee: Westland Aerostructures Limited, Yeovil, England

[21] Appl. No.: 454,994

[22] Filed: Dec. 22, 1989

[30] Foreign Application Priority Data

Dec. 22, 1988 [GB] United Kingdom ..... 8829995

[51] Int. Cl.[5] ..... F16B 1/00; F16D 1/00

[52] U.S. Cl. ..... 403/218; 403/171; 403/176

[58] Field of Search ..... 403/175, 171, 176, 218, 403/170; 52/648

[56] References Cited

U.S. PATENT DOCUMENTS 4,676,043 6/1987 Grimm ..... 52/648

FOREIGN PATENT DOCUMENTS 351378 2/1961 Switzerland ..... 403/175

1283025 7/1972 United Kingdom ..... 403/171

*Primary Examiner*—Andrew V. Kundrat

*Attorney, Agent, or Firm*—Larson & Taylor

[57] ABSTRACT

A joint for joining structural members extending in at least two intersecting planes comprises a pair of outer spaced-apart annular plate members parallel to one of the intersecting planes and sandwiching structural members in that plane, a pair of spaced-apart inner plate members located within the outer plate members and parallel to another of the intersecting planes for sandwiching structural members in the another plane and attachment means for attaching the inner plate members and the outer plate members. The invention also extends to a structure incorporating the joint and modified forms of the joint are disclosed for use on the sides and corners of such a structure.

9 Claims, 3 Drawing Sheets

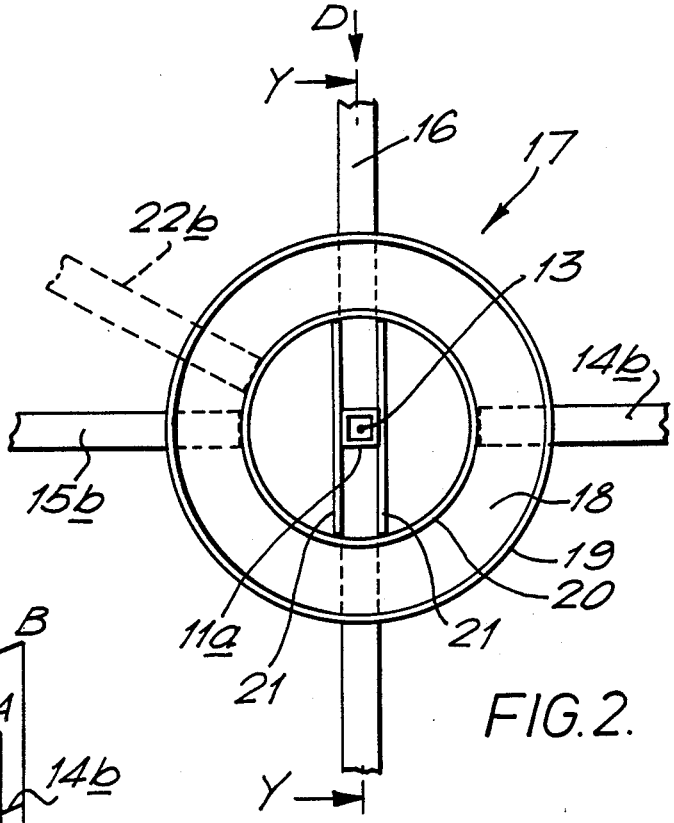
FIG.2.
FIG.1.
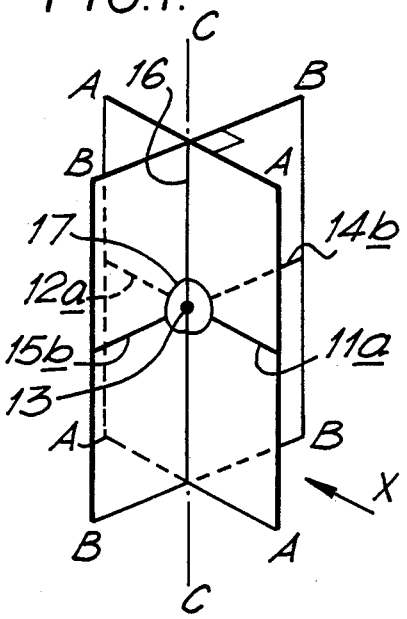
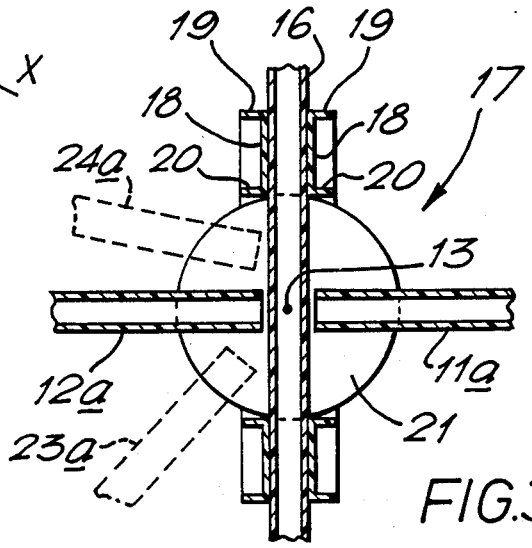
FIG.3.

JOINTS AND STRUCTURES INCORPORATING SAME

BACKGROUND OF THE INVENTION

1. Technical Field

This invention relates to joints, particularly joints for joining structural members extending in at least two intersecting planes, and to structures incorporating same.

The joints of this invention are useful for example in the manufacture of so-called "space structures" in which a plurality of structural members, usually in the form of tubular members constructed of fibre-reinforced plastics material, extending in two or more intersecting planes are joined at their ends to form a lightweight assembly.

2. Description of the Prior Art

U.S. Pat. No. 4,247,218 discloses a joint having a complex shaped base member provided with outwardly extending lugs for attachment to longitudinal elements in one plane and faces formed by a convex polyhedral-shaped surface including means for connection to diagonal longitudinal elements.

A complex multi-part structural joint is disclosed in U.S. Pat. No. 4,330,221 and is adapted for both forming and joining composite intersecting structural members extending in the same plane.

The three-part stacked connector of U.S. Pat. No. 4,355,918 includes recessed formations between adjacent faces for trapping specially headed ends of space frame members. Another joint requiring particular end shapes on interconnected girders is disclosed in U.S. Pat. No. 4,480,418 wherein the spherical ends of a plurality of the girders are located and retained in a joint comprising two substantially hemispherical hollow parts connected by a central bolt.

EP-A No. 0284311 is concerned with a toy or model making structure including a joint capable of being dismantled and comprising threadably engageable disks each having a plurality of concentric rings for engagement by bifurcated ends of elongated link means.

Examples of other complex multi-part joints are to be found in U.S. Pat. No. 3,779,657 and U.S. Pat. No. 4,676,043.

DISCLOSURE OF THE INVENTION

This invention provides a joint for joining structural members extending in at least two intersecting planes wherein the joint comprises a pair of outer spaced-apart annular plate members located parallel to a first one of said intersecting planes for sandwiching structural members extending in that plane, a pair of spaced apart inner plate members located within said outer annular plate members and parallel to another of said intersecting planes for sandwiching structural members extending in said another plane, and attachment means for attaching said inner plate members to said outer annular plate members.

Conveniently, in one embodiment said attachment means comprises a structural member common to said intersecting planes and extended between said outer spaced apart annular plate members and said inner plate members. The common structural member may extend continuously across the inner plate members. The outer annular plate members and the inner plate members may be circular plate members and the structural members may extend from both sides of the joint in both planes. Preferably, reinforcing flanges are provided around both of the inner and outer circumferences of the annular plate members.

In such an embodiment the attachment means may conveniently comprise radial flanges at the periphery of the inner circular plate members for attachment to the reinforcing flanges on the inner circumference of the outer annular plate members.

Either the outer annular plate members or the inner plate members may be semi-circular so that the structural members in the plane of the semi-circular members extend from one side only of the joint so that the joint is particularly suited for use at the sides of a structure.

Alternatively, both of the outer annular plate members and the inner plate members may be semi-circular so that the structural members extend from one side only of the joint in both planes whereby the joint is particularly suited for use at the corners of a structure.

In another aspect this invention provides a structure having a plurality of elongated structural members extending in intersecting planes and joint means for joining ends of said members wherein each joint means comprises a pair of spaced-apart annular plate members located parallel to a first one of said intersecting planes for attachment to the external surface of the ends of structural members extending in that plane, a pair of spaced-apart inner plate members within said outer annular plate members and parallel to another of said intersecting planes for attachment to the external surface of the ends of structural members extending in said another plane, and attachment means for attaching said inner plate members to said outer annular plate members.

BRIEF DESCRIPTION OF THE DRAWINGS

The invention will now be described by way of example only and with reference to the accompanying drawings in which, FIG. 1 is a schematic illustration for explanatory purposes only, FIG. 2 is a side view in the direction of arrow X of FIG. 1 of a joint constructed according to one embodiment of the invention, FIG. 3 is a sectioned view taken on lines Y—Y of FIG. 2.

DETAILED DESCRIPTION OF THE DRAWINGS

Figure 4:
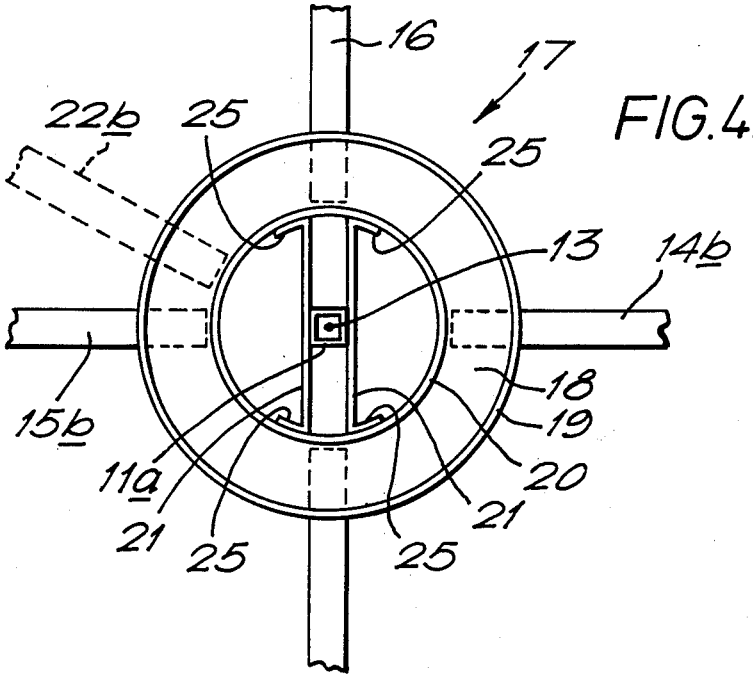
FIG. 4 is a side view similar to FIG. 2 and illustrating a first modified form of the invention.

Referring now to FIG. 1, two orthogonally arranged planes AAAA and BBBB intersect along a common axis C—C. Two structural members 11*a* and 12*a* extend radially from an end spaced-apart from a point 13 located on axis C—C and in plane AAAA and two structural members 14*b* and 15*b* extend radially from an end spaced-apart from the same point 13 and in plane BBBB. A further structural member 16 extends along axis C—C and through point 13.

The structural members 11*a*, 12*a*, 14*b* 15*b* and 16 are joined by a joint 17 shown schematically in FIG. 1 and in detail in FIGS. 2 and 3.

Joint 17 includes a pair of outer spaced-apart annular plate members 18 located parallel to plane BBBB and sandwiching structural member 16 and the ends of structural members 14*b* and 15*b*. The annular plate members 18 are circular and have reinforcing flanges 19 and 20 extending perpendicularly from their surface and around both of the inner and outer circumferences.

A pair of spaced-apart circular inner plate members 21 are located parallel to plane AAAA and centrally within the outer annular plate members 18, and are oriented perpendicular thereto to sandwich structural member 16 and the ends of structural members 11*a* and 12*a*.

Thus, in the illustrated embodiment, structural member 16 is common to both planes AAAA and BBBB (FIG. 1) and extends continuously between the outer annular plate members and the inner plate members to provide a convenient attachment between the outer plate members 18 and inner plate members 21. The outer annular plate members 18 support the ends of structural members such as 14*b* and 15*b* extending in plane BBBB and the inner plate members 21 support the ends of structural members such as 11*a*, 12*a* extending in plane AAAA.

In an application of a joint 17 for joining the structural members of a space structure all of the parts of the joint 17 and the structural members are manufactured of fibre-reinforced thermoplastic materials. As illustrated the structural members are tubular and have a square cross sectional shape.

The respective plates of joint 17 and the structural members 11*a*, 14*b* etc. are all manufactured from a desired number of laminae of fibre-reinforced thermoplastic material to build up a required thickness of material, the components being hot press consolidated with a co-moulded adherent polymer layer incorporated in those parts of the respective components that are to be joined together on assembly.

Final assembly is achieved by fusion bonding of the adherent polymer layers on the surfaces of mating components to provide a strong lightweight joint.

It will be understood that further structural members in both planes such as are shown for example in broken line at 22*b* in FIG. 2 and at 23*a* in FIG. 3 are easily accommodated by the joint 17. Similarly, the structural members need not all extend radially from the common central point 13 and can for example be located generally tangentially thereto as illustrated in broken line at 24*a* in FIG. 3.

The embodiment of FIG. 4 illustrates a modified form of attachment means. Thus structural member 16 does not extend across the inner plate members 21 and, instead, outwardly extended flange portions 25 are provided at least on the peripheral parts of the inner plate members 21 adjacent to the inner flanges 20 of the outer annular plate members. The flanges 20 and 25 are joined by any suitable means such as by bonding.

Figure 5:
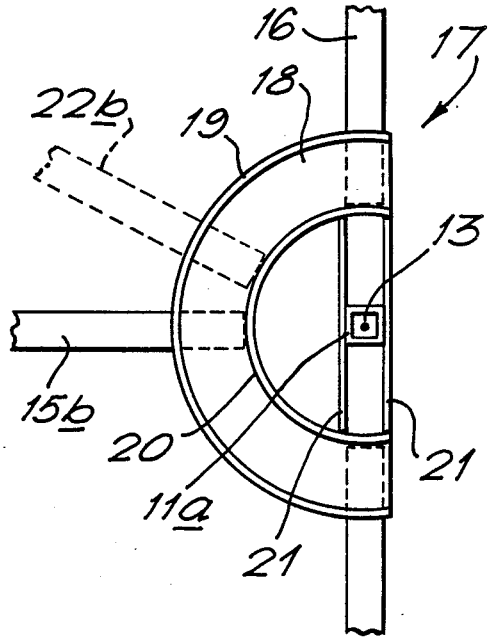
FIG. 5 is another side view similar to FIG. 2 and illustrating a further modified form of the invention.

FIG. 5 illustrates a joint 17 similar to that of FIGS. 2 and 3 except that the outer annular plate members 18 are generally semi-circular and the structural members (e.g. 15*b*) in the plane of the outer plate members 18 extend from one side only of the joint in that plane. Such a joint is useful at the sides of a structure, and a similar facility can be provided by making the inner plate members 21 semi-circular whilst retaining the circular outer annular plate members 18.

Figure 6:
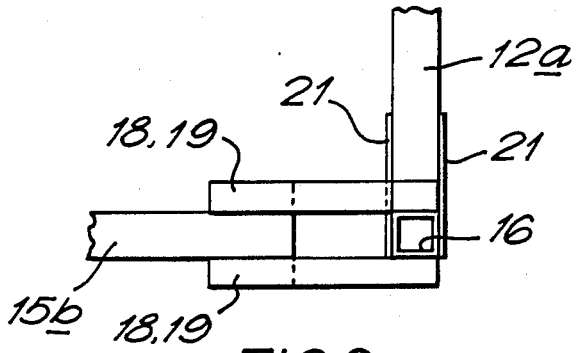
FIG. 6 is an end view taken in the direction of arrow D of FIG. 2 and illustrating a yet further modified form of the invention.

FIG. 6 illustrates a joint in which both the inner and outer plate members are semi-circular and is useful for example at the corners of a structure since the structural members (e.g. 12*a* and 15*b*) extend from one side only of the joint in both of the perpendicularly opposed planes.

Figure 7:
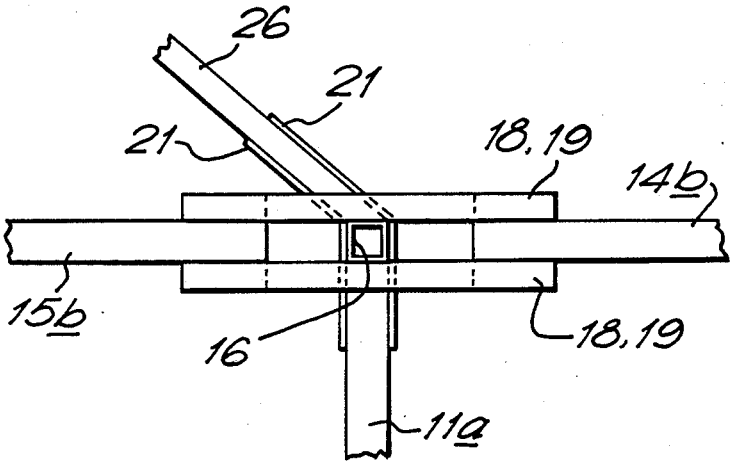
FIG. 7 is an end view similar to FIG. 2 and illustrating a yet further modified form of the invention.

The embodiment of FIG. 7 is useful in a structure having a diagonal structural member as shown for example at 26 to be connected at a joint 17 with structural members such as 16, 11*a*, 14*b* and 15*b* lying in perpendicularly disposed planes as hereinbefore described. This is facilitated by the portions of the inner plate members 21 at one side of the annular outer plate member 18 being at an angle with respect to its remainder in order to sandwich the diagonal structural member 26. In a further unillustrated embodiment the angled portion of inner plate members 21 may comprise a bifurcated angled portion to attach diagonal structural members in two planes.

Thus, the joint 17 of this invention provides direct load paths across the joint by transferring all structural member loads in one plane through the inner plate members 21 and transferring all structural member loads in the other plane through the outer annular plate members 18. Loads are transferred between the two pairs of plates by attachment means which in the embodiment of FIGS. 2 and 3 comprises the common structural member 16 and in the embodiment of FIG. 4 comprises the mated flanges 20 and 25.

The joint 17 therefore provides a lightweight, high strength and extremely versatile means of joining structural members extending in at least two intersecting planes.

Whilst one embodiment has been described and illustrated it will be understood that many modifications may be made without departing from the scope of the invention. For example common structural member 16 need not be continuous across inner plate members 21 provided that enough bond length is provided to transfer loads across the plates and the inner plate members 21 can be attached to the outer annular plate members 18 by any other suitable attachment means. The joint may be of any suitable material and may be used for joining structural members of other materials, and in such embodiments the parts can be attached using any appropriate means such as bonding, bolting, riveting etc. One or more additional pairs of annular plate members outside the annular plate members 18 can be provided and can be used to join structural members in other intersecting planes, and the outer annular plate members 18 and the inner plate members 21 can be other than circular in shape and may for example be rectangular.

I claim:

1. A joint for joining structural members extending in at least two intersecting planes comprises a pair of outer spaced-apart annular plate members located parallel to a first one of said intersecting planes for sandwiching structural members extending in that plane, a pair of spaced-apart inner plate members located within said annular plate members and parallel to another of said intersecting planes for sandwiching structural members extending in said another plane, and attachment means for attaching said inner plate members to said outer annular plate members.

2. A joint as claimed in claim 1, wherein said attachment means comprises a structural member common to said intersecting planes and extended between said outer annular plate members and said inner plate members.

3. A joint as claimed in claim 2, wherein said common structural member extends continuously across the inner plate members.

4. A joint as claimed in claim 1, wherein said outer annular plate members and said inner plate members are circular plate members and the structural members extend from both sides of the joint in both planes.

5. A joint as claimed in claim 4 and including reinforcing flanges around both of the inner and outer circumferences of said annular plate members.

6. A joint as claimed in claim 5, wherein said attachment means comprise radial flanges at the periphery of said inner circular plate members for attachment to the reinforcing flanges on the inner circumference of the outer annular plate members.

7. A joint as claimed in claim 1, wherein either the outer annular plate members or the inner plate members are semi-circular so that the structural members in the plane of the semi-circular members extend from one side only of the joint whereby the joint is particularly suited for use at the sides of a structure.

8. A joint as claimed in claim 1, wherein both the outer annular plate members and the inner plate members are semi-circular so that the structural members extend from one side only of the joint in both planes whereby the joint is particularly suited for use at the corners of a structure.

9. A structure having a plurality of elongated structural members extending in intersecting planes and joint means for joining ends of the members wherein each joint means comprise a pair of spaced-apart annular plate members located parallel to a first one of said intersecting planes for attachment to the external surface of the ends of structural members extending in that plane, a pair of spaced-apart inner plate members within said outer annular plate members and parallel to another of said intersecting planes for attachment to the external surface of the ends of structural members extending in said another plane, and attachment means for attaching said inner plate members to said outer annular plate members.

* * * * *